US006536048B2

(12) United States Patent
Frye

(10) Patent No.: US 6,536,048 B2
(45) **Date of Patent: *Mar. 25, 2003**

(54) ADJUSTABLE DISPOSABLE GARMENT PROTECTOR

(76) Inventor: Greg M. Frye, 15820 Knoll Trail, Apartment 633, Dallas, TX (US) 75205

( * ) Notice: Subject to any disclaimer, the term of this patent is extended or adjusted under 35 U.S.C. 154(b) by 0 days.

This patent is subject to a terminal disclaimer.

(21) Appl. No.: 09/933,649

(22) Filed: Aug. 20, 2001

(65) Prior Publication Data

US 2001/0054191 A1 Dec. 27, 2001

Related U.S. Application Data

(63) Continuation of application No. 09/351,659, filed on Jul. 13, 1999.

(51) Int. Cl.[7] ..... A41B 13/10
(52) U.S. Cl. ..... 2/49.2; 2/49.1
(58) Field of Search ..... 2/49.1, 49.2, 49.5, 2/48, 49.3, 49.4, 50, 51, 52

(56) References Cited

U.S. PATENT DOCUMENTS

| | | | | |
|---|---|---|---|---|
| 497,340 | A | | 5/1893 | Pollitt |
| 615,293 | A | | 12/1898 | Maier |
| 1,591,721 | A | * | 7/1926 | Melvin |
| 1,979,632 | A | | 11/1934 | McClure ..... 150/2 |
| 2,164,369 | A | * | 7/1939 | Woolever |
| 2,265,690 | A | | 12/1941 | Fiedler ..... 2/49 |
| 2,367,383 | A | | 1/1945 | Tiscornia ..... 2/49 |
| 2,651,039 | A | | 9/1953 | Tonkens et al. |
| 2,704,625 | A | | 3/1955 | Huse |
| 4,114,199 | A | | 9/1978 | Malan ..... 2/49 A |
| 4,441,212 | A | | 4/1984 | Ahr et al. ..... 2/49 |
| 4,601,065 | A | | 7/1986 | Sigl et al. ..... 2/49 |
| 4,622,698 | A | | 11/1986 | Heyman et al. ..... 2/49 |
| 4,649,572 | A | | 3/1987 | Roessler ..... 2/49 |
| 4,702,523 | A | | 10/1987 | Schrader et al. ..... 497/485 |
| 4,793,004 | A | | 12/1988 | Long et al. ..... 2/49 |
| D304,777 | S | | 11/1989 | Glenn ..... D2/229 |
| 4,915,278 | A | | 4/1990 | Smith ..... 224/205 |
| 4,946,094 | A | | 8/1990 | Stang ..... 224/270 |
| 4,985,932 | A | | 1/1991 | Bezdek ..... 2/49 |
| 5,062,558 | A | | 11/1991 | Stang ..... 224/270 |
| 5,107,545 | A | | 4/1992 | Potter ..... 2/46 |
| 5,244,278 | A | | 9/1993 | Robitaille ..... 383/4 |
| 5,483,701 | A | | 1/1996 | Ferreyros ..... 2/49.2 |
| 5,504,941 | A | | 4/1996 | Sell ..... 2/49.2 |
| 5,509,141 | A | * | 4/1996 | Saltzman ..... 2/49.2 |
| 5,649,654 | A | | 7/1997 | Hayward, Jr. ..... 224/270 |
| 5,799,366 | A | | 9/1998 | Zocco et al. |
| 5,850,956 | A | | 12/1998 | Hayward, Jr. ..... 224/270 |
| 5,875,490 | A | | 3/1999 | Woodard et al. ..... 2/49.1 |
| 5,918,311 | A | | 7/1999 | Lampson et al. ..... 2/49.2 |
| 5,930,836 | A | | 8/1999 | Morris ..... 4/49.1 |
| 5,960,471 | A | * | 10/1999 | Burton ..... 2/48 |
| 6,058,506 | A | | 5/2000 | Reinhard, Jr. ..... 2/49.2 |
| 6,061,827 | A | * | 5/2000 | Lampson et al. ..... 2/49.1 |
| 6,128,780 | A | * | 10/2000 | Reinhart et al. ..... 2/49.2 |
| 6,141,799 | A | * | 11/2000 | Morris ..... 2/52 |
| 6,182,290 | B1 | * | 2/2001 | Morris ..... 2/49.1 |
| 6,308,333 | B1 | * | 10/2001 | Jackson ..... 2/49.4 |
| 6,332,220 | B1 | * | 12/2001 | Mai ..... 2/51 |

* cited by examiner

*Primary Examiner*—John J. Calvert
*Assistant Examiner*—Alissa L. Hoey
(74) *Attorney, Agent, or Firm*—F. Lindsey Scott

(57) ABSTRACT

According to the present invention, an adjustable disposable garment protector is provided and includes a protector support adapted to support the garment protector from the neck of a user; a protector cover supported at its first end by the protector support in a position covering a front portion of the chest and stomach of the user; and, a pouch positioned on the second end of the protector cover, the pouch being formed to fold to one of a first closed position for storage and a second opened position having its top end opened and positioned to collect particulates and liquids moving downwardly along the front surface of the garment protector. The disposable garment protector may also be fabricated as a convertible food bag.

16 Claims, 4 Drawing Sheets

10
12
14
16
18
22
24
24a
24c
24d
26
34
34a
34c
34d
36
42
44
44'
46
50
51
52
62
62'
64
66
66a
66b
66c
66d
68
70
72
84
86

ADJUSTABLE DISPOSABLE GARMENT PROTECTOR

This is continuation of application Ser. No. 09/351,659 filed on Jul. 13, 1999.

FIELD OF THE INVENTION

This invention relates to an adjustable, disposable garment protector useful to protect the garments of a user from spills, dropped food and the like during the consumption of food and beverages, particularly fast food beverages. The invention also relates to a convertible food bag and a method for packaging the disposable garment protector and a method for disposing of the disposable garment protector and its contents after use.

BACKGROUND OF THE INVENTION

Garment protectors have been used to protect the front of infants during feeding or dining and diners eating particularly messy foods such as lobsters and the like for many years. However, most such garment protectors simply consist of a cloth-like garment protector supported at the back of the neck of a user and do nothing to catch liquids or foods which may be spilled on the garment protector and pass downwardly over the surface of the garment protector and onto the garments of the user.

Such garment protectors do not serve the needs of modern consumers who frequently purchase food at fast food drive-ins or drive-throughs for consumption in an automotive vehicle while moving on crowded roadways and the like. Garment protectors for such use should not only be easily disposable but they should also provide a means for containing any waste materials spilled and provide for a method of disposing of both any spilled food particles, liquids and the like as well as the garment protector itself after the user has finished dining.

Accordingly, a continuing search has been directed to the development of a disposable garment protector which protects the garments of a user while dining in automobiles, school cafeterias, offices, picnicking, or like activities and provides for the disposal of any spilled or dropped food particles, liquids or packaging and for the disposal of the garment protector itself.

SUMMARY OF THE INVENTION

According to the present invention, an adjustable disposable garment protector is provided and comprises a protector support adapted to support the garment protector from the neck of a user; a protector cover having a front surface and a back surface, a first side and a second side, a first and a second end and supported at its first end by the protector support in a position covering a front portion of the chest and stomach of the user; and, a pouch positioned on the second end of the protector cover, the pouch having a top end and a bottom end, a front and a back and being formed to fold to one of a first closed position for storage and a second opened position having its top end opened and positioned to collect particulates and liquids moving downwardly along the front surface of the garment protector in use.

The garment protector may also be fabricated as a convertible food bag which is convertible into an adjustable disposable garment protector, the convertible food bag comprising a food bag having a front and a back, a first side and a second side, a top and a bottom, a disposable garment protector support adapted to support the disposable garment protector from the neck of a user, a pouch formed by a lower portion of the bag and having a top and a bottom end, a front and a back and being formed to fold to one of a closed position for storage and a second opened position having its top end open and a tearable perforation or a cut across the front, first side and second side of the bag so that the bag above the top of the pouch is foldable to a closed position to form a protector cover having a front surface and a back surface, a first side and a second side, a first and a second end and supported at its first end by the protector support in a position covering a front portion of the chest and stomach of the user.

BRIEF DESCRIPTION OF THE DRAWINGS

The FIG. 1 is a front view of an adjustable, disposable garment protector according to the present invention.

DESCRIPTION OF THE PREFERRED EMBODIMENTS

In the description of the Figures the same numbers will be used throughout to refer to the same or similar components.

Figure 1:
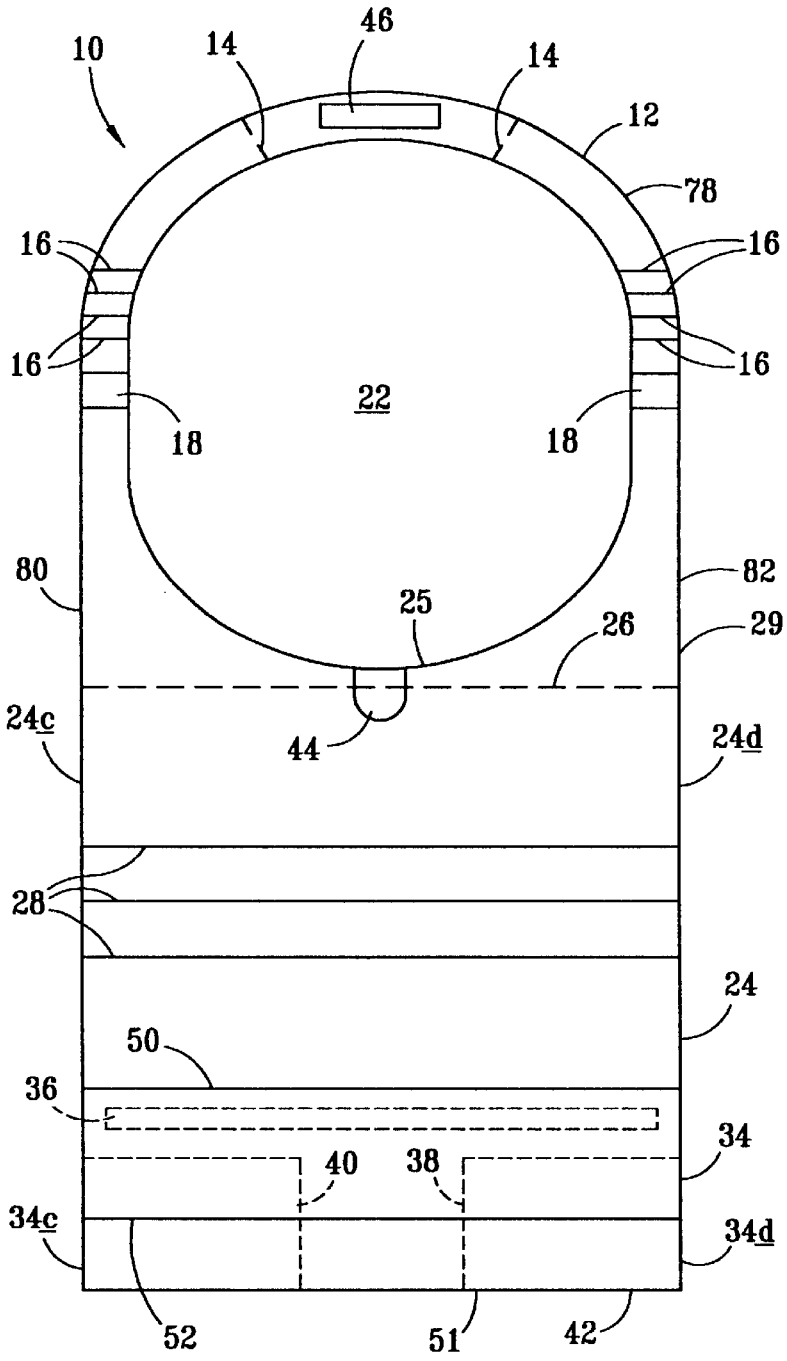

In FIG. 1 an adjustable, disposable garment protector 10 is shown. Garment protector 10 comprises a support 12 adapted to support garment protector 10 in position about the neck of a user. Support 12 includes at least one perforation 14 (two are shown) which are included to permit rapid removal of support 12 in the event of an emergency. Perforations 14 are positioned near the upper part of support 12 which would be near the back of the user. Perforations 14 could also be placed at any place along the length of support 12. Support 12 as shown in FIG. 1 also includes a plurality of creases 16 which may be bent at a first crease and doubled back at another crease and stuck to adhesive patches 18 to shorten support 12. At least one adhesive patch 18 is positioned as shown in FIG. 1 and more clearly shown in FIG. 2 to facilitate shortening support 12 in this fashion. Support 12 defines an opening 22 in its center which is the space occupied by the neck of the user as the disposable garment protector is positioned for use. This center section may comprise a napkin material which is readily removed by breaking perforations surrounding center 22 or it may comprise a sheet containing games for the amusement of children or adults and the like. The center napkin or the like is perforated for removal without tearing perforations 14. The center 22, as well as other surfaces of the disposable garment protector, may be used for advertising, decorative materials or the like. In fact it is contemplated that most of the exposed surfaces of the disposable garment protector 10 will be used for advertising or decorative materials.

Figure 12:
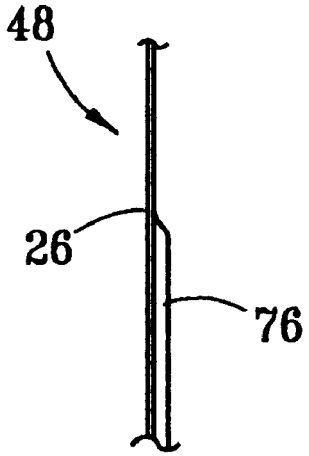

A protector cover 24 is supported by support 12 and is configured to cover a front portion of the chest and stomach of the user. The protector cover section desirably comprises an absorbent towel or napkin-like soft, absorbent material 48 on its front surface. As shown in FIGS. 1 and 12, a water-impervious layer 76 is desirably positioned on a portion of a back 246 of disposable garment protector 10. Typically the impervious layer extends behind the lower portion of garment protector 10 for example below a dotted line 26 in FIG. 1. Protector cover 24 extends downwardly to its bottom 42 which is shown in FIG. 1 to be the same as a bottom 51 of a pouch 34. Pouch 34 has a front 34*a,* a back 34*b,* a first side 34*c* and a second side 34*d* and is positioned generally at the bottom of protector cover 24.

A plurality of creases 28 may be positioned in protector cover 24 in a folded position so that protector cover 24 can be pulled downwardly to unfold creases 28 to lengthen protector cover 24. A pouch 34, which is generally a fold-out pouch, is shown to fold out in a fashion similar to the bottom of a paper bag. As shown more fully in FIG. 2, a plurality of folds 52 are positioned at sides 34*c* and 34*d* of pouch 34 so that pouch 34 may be folded to a closed position as shown in FIG. 3 with its bottom positioned near a front surface 24*a* of protector cover 24.

By reference to FIG. 1, fold-out inner pouches 38 and 40 are shown by dotted lines. These pouches may be positioned to be folded out by the user inside pouch 34 or designed as an integral part of pouch 34 to fold out as desired by the user to hold barbeque sauce, catsup, salad dressing, or the like. The use of the inner pouches is optional but may be desirable in many instances. Further, a plurality of fold-out inner pouches may be used.

Figure 2:
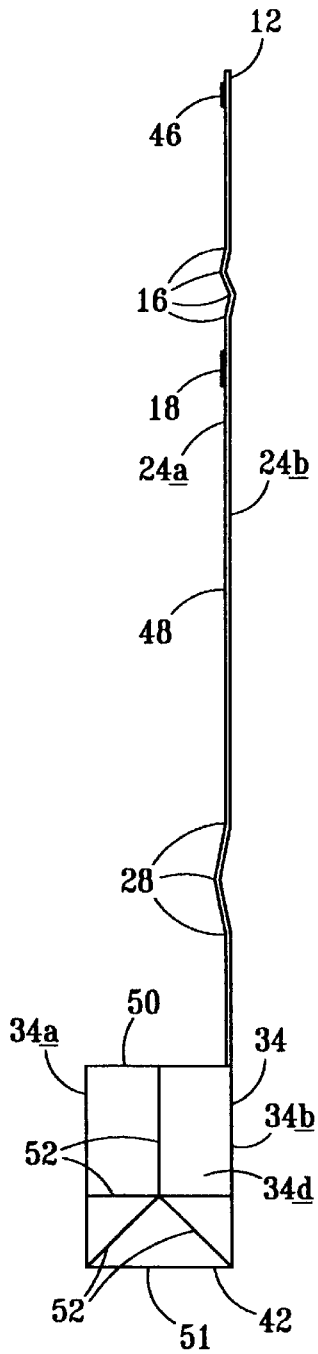
FIG. 2 is a side view of the embodiment of the present invention shown in FIG. 1.

In FIG. 2, a side view of the embodiment shown in FIG. 1 is shown. Adhesive strip 20 is shown in combination with creases 16 to shorten protector cover 34 with creases 28 shown in a closed (initial) position. Pouch 34 is shown in its open position.

Figure 3:
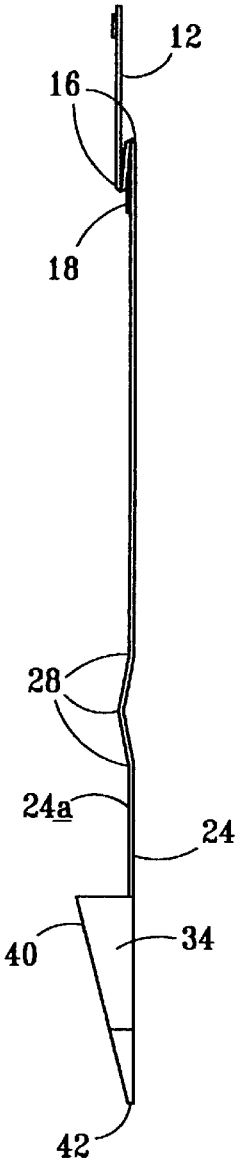
FIG. 3 is a side view of the embodiment of the present invention shown in FIG. 1 with the protector support in a shortened position, with the pouch in a closed position.

In FIG. 3, pouch 34 is shown in a closed position and folded against front 24*a* of protector cover 24. Creases 28 are in their open position to lengthen protector cover 24.

Figure 6:
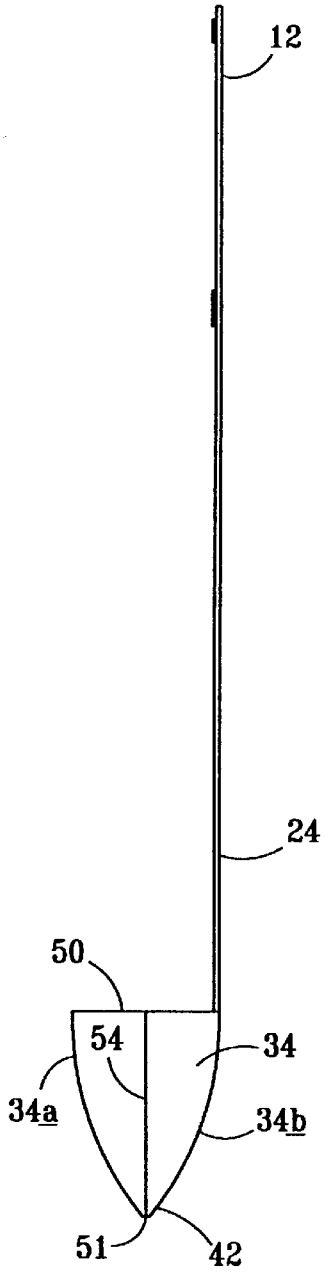
FIG. 6 is a side view of an alternate embodiment of the embodiment of the invention shown in FIG. 1 with a different type of pouch.

In FIG. 6, an alternate configuration of pouch 34 is shown. This pouch folds differently but includes a fold 54 and collapses against protector cover 24 for storage.

Figure 7:
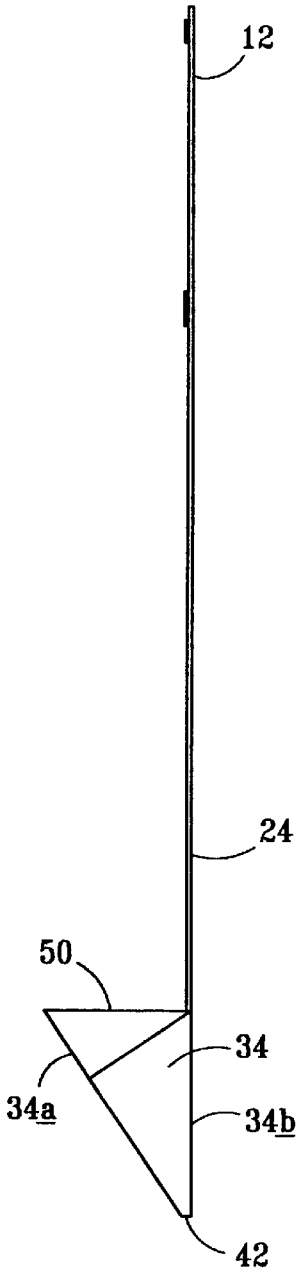
FIG. 7 is a side view of the embodiment of the invention shown in FIG. 1 wherein a further alternate type pouch is shown.

FIG. 7 shows a further embodiment of pouch 34 which also collapses against the front of protector cover 24 for storage.

Figure 4:
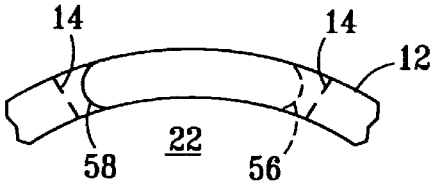
FIG. 4 is an alternate embodiment of the protector support shown in FIG. 1.
Figure 5:
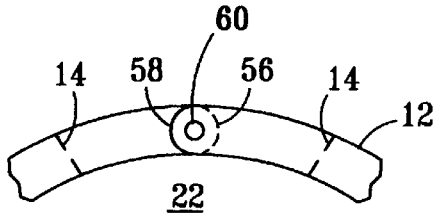
FIG. 5 is a further variation of the protector support shown in FIG. 1.

In FIG. 4, an alternate embodiment of support 12 is shown. The embodiment shown in FIG. 1 is basically a slipover design where support 12 constitutes a single strap which may be adjusted by creases and adhesives. In FIG. 4 two straps are shown. The straps are joined to a first side 24*c* and a second side 24*d* of a first end 25 (top) of protector cover 24 and are overlapped with an end 56 of a first strap and an end 58 of a second strap. The straps can be joined by VELCRO, adhesives or as shown in FIG. 5 by a snap 60 or the like. In both FIGS. 4 and 5 perforations 14 are shown. A variety of fasteners can be used such as VELCRO, adhesives, snaps, buttons, tying, the use of a continuous strap with a slipover fit and the like. Such variations are well known to those skilled in the art.

Figures 8, 9, 10:
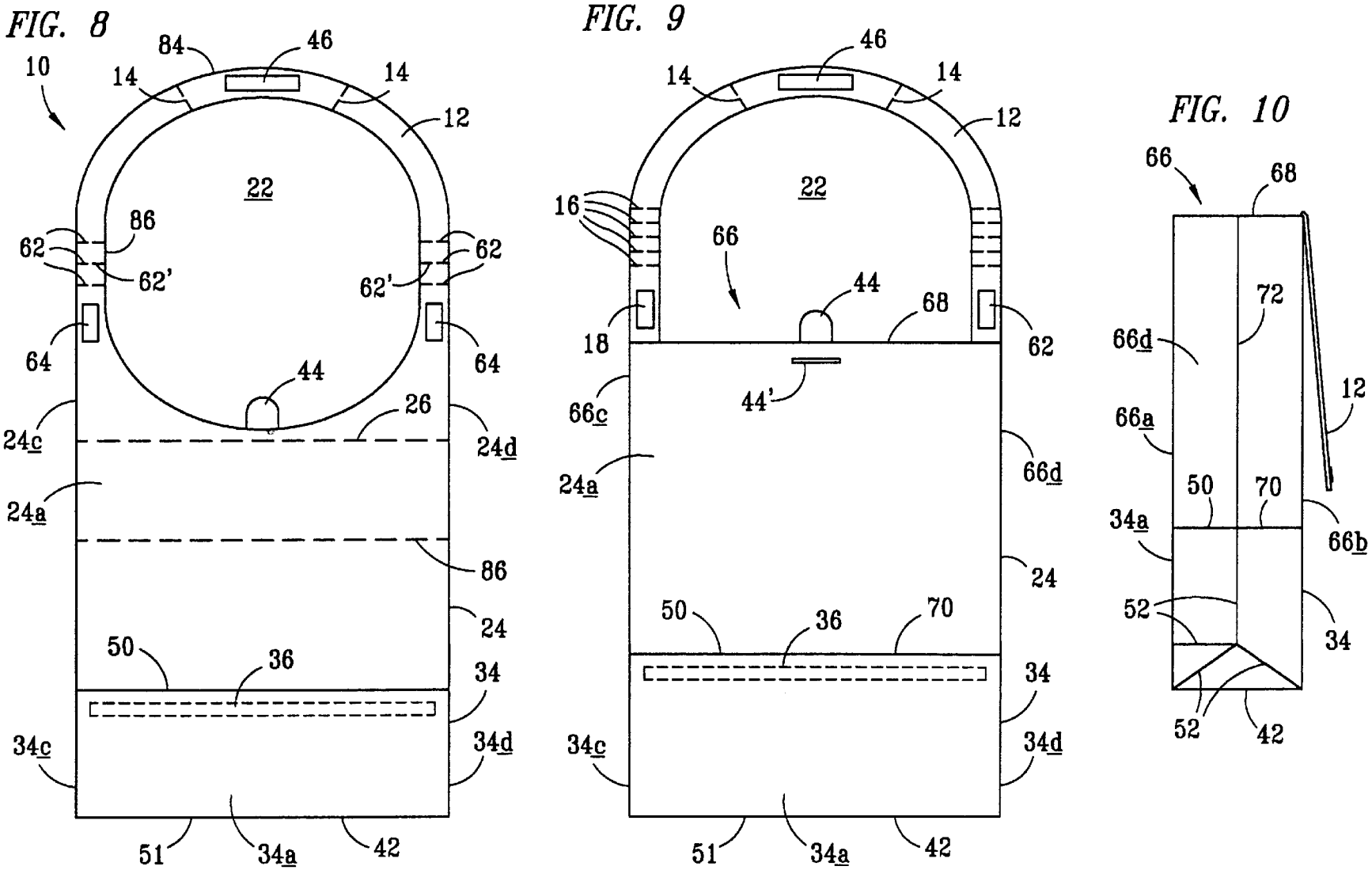
FIG. 8 is a front view of an alternate embodiment of the present invention.
FIG. 9 is a front view of an alternate embodiment of the present invention wherein the adjustable, disposable garment protector is fabricated as a food bag.
FIG. 10 is a side view of the embodiment of the invention shown in FIG. 9 with the protector support collapsed to a position beside the back of the food bag.

In the embodiment of the invention shown in FIG. 8, a plurality of perforations 62 are shown in each side of a strap 12. A single perforation could be used, and two straps could be used but for convenience a plurality of perforations is shown in a slip-over strap. In this embodiment, strap 12 may be shortened by tearing one of the perforations on each side and moving the end (strap tear end) of the strap removed at the perforation to engage a adhesive shown at 64. By selection of the desired perforation, strap 12 can be shortened to any desired length.

In other respects, the embodiment shown in FIG. 8 is similar to the embodiment shown in FIG. 1.

Figure 11:
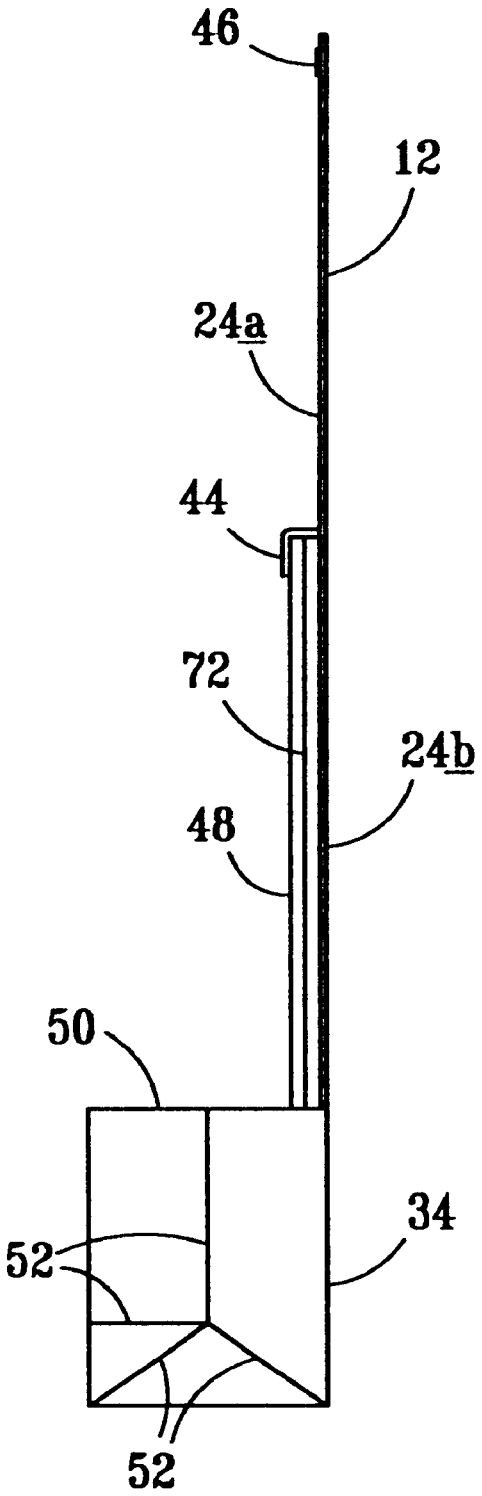
FIG. 11 shows the convertible food bag shown in FIG. 10 as configured for use as an adjustable, disposable garment protector; and, FIG. 12 shows a cross-section of the front of a protector cover and the positioning of an impermeable layer on the back of the front portion of the protector cover in a lower portion of the protector cover.

In the embodiment shown in FIG. 9, a food bag convertible to become a disposable garment protector is shown. The food bag 66 has a top 68 and a front 66*a,* a back 66*b* and first and second sides 66*c* and 66*d* respectively. A support 12 as discussed in conjunction with FIG. 8 is positioned to extend above back 66*b* of food bag 66. As shown in FIG. 9, during use of the bag, support 12 is bent downwardly along the back 66*b* of food bag 66. In this configuration the bag is readily used to serve food and the like. Bag 66 includes a pouch 34 as described in conjunction with FIG. 1. Further bag 66 includes a cut 70 or a perforation which is easily tearable along front 66*a* and sides 66*c* and 66*d* of food bag 66, but strong enough to permit use of the bag as a container. This permits the bag sections above top 50 of pouch 34 to be separated and folded back against front 24*a* of protector cover 24. A clip or tab 44 made of a suitable deformable material such as treated paper or the like is positioned on the top of back 66*b* of bag 66 and is used as shown in FIG. 11 for deformation to hold the collapsed upper sections of bag 66 in a collapsed position against front 24*a* of protector cover 24. Tab 44 may be of the same material as bag 66 and may be insertable into a slot 44' inside 66A of bag 66 for mating engagement with tab 44, to hold the collapsed upper sections of bag 66 in a collapsed position. In this configuration, the bag is readily used as a disposable garment protector. The bag may also be fabricated from a clear plastic or the like so that the contents of the bag can be seen by the purchaser. Bags of this type are also suitable for conversion to a garment protector as discussed above.

In FIG. 12 a cross-section of the back 24*b* of protector cover 24 is shown. A front layer 48 comprises a soft, absorbent material such as a towel or napkin-like material which has suitable strength to form support 12. A backing 76 is positioned by bonding it to the back of the front layer 48. This configuration permits the bag to be fabricated economically by placing the water repellant material only on the lower portion of the disposable garment protector where it is needed rather than behind the front of the entire disposable garment protector. Of course, no such backing is required when a plastic bag is used. Such fabricaton techniques are well known to those skilled in the art.

Various adhesives have been referred to in the discussion of the present invention. These adhesives are adhesive strips which are preferably covered with a peelable or otherwise readily removable covering so that the adhesive is not activated until it is desired by the user to do so. Such adhesives are readily available and form no part of the present invention except as they may function in conjunction with other components of the collapsible garment protector.

In FIGS. 1, 8 and 9, an adhesive strip 46 is shown near the top of support 12. This strip is used to retain the disposable garment protector in a rolled-up position when the user has finished with it. When the user has finished his meal, an adhesive strip 36 is used to close pouch 34. The pouch then contains any spilled or discarded materials or the like which have been placed in pouch 34. Pouch 34 can also be used for the disposal of napkins, empty packages and the like consistent with the size of pouch 34. After pouch 34 has been closed, the garment protector may be rolled into a tight roll and retained in the tight roll by use of adhesive strip 46. This permits the economical use of space in a vehicle with the waste materials from the meal contained in the disposable garment protector. Similarly tab 44 shown in FIG. 8 may be formed as an adhesive tab and used in a similar fashion or an adhesive tab may be used in lieu of tab 44.

By the use of the present invention, a user may safely purchase and consume fast food products while occupying a vehicle or the like without risk of soiling the users' garments. After the disposable garment protector has been used, it can then be utilized to store spills and other refuse from the consumed meal in a fashion consistent with the maintenance of neatness in the vehicle and the like until an opportunity to dispose of the disposable garment protector is available.

The disposable garment protectors may be stored in flat containers from which they are removed sequentially by use of a tab 44 as shown in FIG. 1. The tab in FIG. 1 is adapted to be grasped by a user of the disposable garment protector, or a third party dispersing the disposal garment protector to a user, for the removal of a disposable garment protector from a storage box, drawer or the like in which the disposable garment protectors are positioned as flat stackable disposable garment protectors. Alternatively, the disposable garment protector may be folded at lines such as line 86 and at perforations 62' in FIG. 8 if folded with pouch 34 facing downwardly along line 86 with support 12 being folded upwardly and over the remaining portions of disposable garment protector 10 at perforation 62'. The disposable garment protectors may be placed in a smaller container and again may be removed by grasping tab 44 which may comprise a covered adhesive tab. This permits the storage of disposable garment protectors in a smaller container which may be somewhat taller but occupies a smaller horizontal space than when the disposable garment protectors are stacked in the flattened form. Many variations in the packaging of disposable products, such as the adjustable disposable garment protectors, are possible and well-known to those skilled in the art.

Having thus described the present invention by reference to certain of its preferred embodiments, it is pointed out that many variations and modifications are possible within the scope of the present invention.

I claim:

1. A disposable garment protector comprising:

a) a protector support adapted to support the garment protector from the neck of a user;

b) a protector cover having a front surface and a back surface, a first side and a second side, a first and a second end and supported at its first end by the protector support in a position covering a front portion of the chest and stomach of the user; and, c) a fold out pouch positioned on the second end of the protector cover, the fold out pouch having a top end, a bottom end, first and second sides, a front and a back and being formed to fold from one of a closed position against the protector cover for storage prior to use and a second fold out opened position having its top end opened and positioned to collect particulates and liquids moving downwardly along the front surface of the protector cover during use, the fold out pouch being foldable to the closed position after use, the first and second sides of the pouch being creased and folded in the closed position and at least partially unfolded in the opened position, the sides being joined to the protector cover and the front and back and bottom of the pouch.

2. The garment protector of claim 1 wherein the protector support comprises a strap having a first end and a second end and positioned to extend from the first end of the strap joined to the first side of the first end of the protector cover around the back of the neck of the user to the second end of the strap joined to the second side of the protector cover.

3. The garment protector of claim 2 wherein the strap includes at least one tearable perforation which when torn permits a quick removal of the protector from the neck of the user.

4. The garment protector of claim 2 wherein the strap includes at least one tearable perforation and at least one adhesive section positioned on the strap so that when the tearable perforation is torn, a first strap tear end including the adhesive section and a second strap tear end are produced so that the second strap tear end is joinable to the adhesive section on the first strap tear end to change the length of the strap.

5. The garment protector of claim 1 wherein the protector support comprises two strap sections, a first strap section having its first end joined to the first side of the first end of the protector cover and a second end and a second strap section having a first end and having its first end joined to the second side of the first end of the protector cover with a second end portion of the first strap section and a first end portion of the second strap section being joinable to form the strap.

6. The garment protector of claim 5 wherein the strap includes at least one tearable perforation which when torn permits removal of the protector from the neck of the user.

7. The garment protector of claim 5 wherein each strap section includes at least one tearable perforation and an adhesive section positioned on the strap section so that when the tearable perforation is torn, a first strap section tear end including the adhesive section and a second strap section tear end are produced so that the second strap section tear end is joinable to the adhesive section on the first strap section tear end to change the length of the strap section.

8. The garment protector of claim 1 wherein the protector cover includes at least two creases positioned below the first end of the protector cover and above the top of the pouch end extending substantially across the protector cover and positioned so that when the creases are bent the protector cover is retained in a shortened position and when the creases are straightened the protector cover is in a lengthened position.

9. The garment protector of claim 1 wherein the pouch is formed by positioning a plurality of folds in the sides of the pouch so that the pouch is foldable to a closed position with its bottom being flat and generally parallel to the front of the protector cover.

10. The garment protector of claim 9 wherein the pouch also includes at least one fold across the front of the pouch to enable the bottom of the pouch to open to a position orthogonal to the protector cover.

11. The garment protector of claim 1 wherein a covered adhesive section is positioned inside and near the top of the front of the pouch so that when the pouch has been used it may be adhesively closed near the top of the pouch.

12. The garment protector of claim 1 wherein the protector support includes a covered adhesive positioned so that when an adhesive cover is removed the pouch may be closed, the protector cover and the protector support may be rolled around the pouch and retained in position by adhesively joining the protector support to the back of the protector cover.

13. The garment protector cover of claim 1 wherein the protector cover comprises a soft, absorbent material on its front side and a liquid repellant material bonded to the soft absorbent material positioned on the back of the soft absorbent material on a lower portion of the protector cover to form the back of the protector cover in the lower portion.

14. The garment protector of claim 1 wherein the pouch includes at least one inner pouch.

15. The garment protector of claim 14 wherein at least one inner pouch is seperately openable to its open position in the pouch.

16. The garment protector of claim 1 wherein a removable center section of the protector support is useable as at least one of a napkin, a game sheet, an advertising display and a decorative display.

* * * * *